US008705249B2

(12) United States Patent
Luppold et al.

(10) Patent No.: US 8,705,249 B2
(45) Date of Patent: Apr. 22, 2014

(54) METHOD FOR MANUFACTURE OF A FUSE FOR A PRINTED CIRCUIT BOARD

(75) Inventors: Michael Luppold, Dettenheim (DE); Alexander Dauth, Maulbronn (DE)

(73) Assignee: Borgwarner Beru Systems GmbH, Ludwigsburg (DE)

( * ) Notice: Subject to any disclaimer, the term of this patent is extended or adjusted under 35 U.S.C. 154(b) by 462 days.

(21) Appl. No.: 12/873,616

(22) Filed: Sep. 1, 2010

(65) Prior Publication Data

US 2011/0051388 A1 Mar. 3, 2011

(30) Foreign Application Priority Data

Sep. 3, 2009 (DE) ..... 10 2009 040 022

(51) Int. Cl.
*H01R 9/00* (2006.01)

(52) U.S. Cl.
USPC ..... 361/776; 361/772; 361/774; 174/164

(58) Field of Classification Search
USPC ..... 361/767, 770–772; 174/260–264
See application file for complete search history.

(56) References Cited

U.S. PATENT DOCUMENTS

| | | | | |
|---|---|---|---|---|
| 5,097,247 | A | 3/1992 | Doerrwaechter | |
| 5,192,940 | A | 3/1993 | Yajima et al. | |
| 6,198,376 | B1 | 3/2001 | Ishikawa et al. | |
| 6,630,631 | B1 * | 10/2003 | Dishongh et al. | 174/262 |
| 7,645,940 | B2 * | 1/2010 | Shepherd et al. | 174/250 |
| 8,097,815 | B2 * | 1/2012 | Watanabe | 174/266 |
| 2003/0048620 | A1 | 3/2003 | Nishimura et al. | |
| 2003/0064546 | A1 * | 4/2003 | McCormick et al. | 438/108 |
| 2003/0184986 | A1 * | 10/2003 | Soga et al. | 361/767 |
| 2005/0001710 | A1 | 1/2005 | Mukai et al. | |
| 2006/0267721 | A1 | 11/2006 | Graf et al. | |
| 2006/0268645 | A1 | 11/2006 | Graf et al. | |

FOREIGN PATENT DOCUMENTS

| | | |
|---|---|---|
| DE | 10 2005 024 321 | 11/2006 |
| DE | 10 2005 024 346 | 11/2006 |
| EP | 0 373 528 | 6/1990 |

OTHER PUBLICATIONS

European Search Report issued in corresponding European Application No. EP 10 00 8025 on Feb. 1, 2011.

* cited by examiner

*Primary Examiner* — Tuan T Dinh
(74) *Attorney, Agent, or Firm* — Greer, Burns & Crain Ltd.

(57) ABSTRACT

Some invention embodiments relate to a method for forming a fuse which electrically connects two metal surfaces (2) that are arranged on a printed circuit board (4) next to each other and spaced apart from each other. It is provided according to the invention that the two metal surfaces (2) are each partially covered with a protective coating (5), wherein a partial region forming a contact region (2*a*) remains uncovered, liquid soft solder material (1) which bridges the gap between the two metal surfaces (2) is applied onto the two uncovered partial regions (2*a*), and the protective coating (5) in a surrounding area of the solder material (1) is removed after the soft solder material (1) has solidified, in order to form receiving regions (2*b*) which are wetted by the solder material (1) when the latter fuses, with the result that the solder material (1) flows off from a printed circuit board region (3) between the two metal surfaces (2) and the electrical contact formed by the solder material (1) is interrupted. Furthermore, other invention embodiments relate to a printed circuit board with such a fuse.

7 Claims, 2 Drawing Sheets

METHOD FOR MANUFACTURE OF A FUSE FOR A PRINTED CIRCUIT BOARD

FIELD

One aspect of the invention relates to a method for forming a fuse which electrically connects two metal surfaces that are arranged on a printed circuit board next to each other and spaced apart from each other. Furthermore, another aspect of the invention relates to a printed circuit board with such a fuse.

BACKGROUND

In the event of a fault, circuits arranged on printed circuit boards can result in extreme overtemperatures. To be protected, circuits are, therefore, usually equipped with fuses, temperature switches, current-limiting PTC elements, or similar components.

SUMMARY

The present invention aims at presenting a way of reliably achieving as cost-effectively as possible and with as low space requirements as possible that, in the event of a fault, a load current can be interrupted or, at least, be reduced as far as necessary to prevent secondary damage.

This problem is solved by a method according to the invention comprising the feature presented in claim 1 as well as by a printed circuit board with a fuse. Advantageous further developments of the invention are the subject matter of subordinate claims.

A fuse according to the invention bridges a gap between two metal surfaces with soft solder material such that an electrical contact can be established between the two metal surfaces, said metal surfaces being arranged on the printed circuit board next to each other. Therein, the soft solder material covers only a part of each of the metal surfaces. A further part of the metal surfaces in the environment of the soft solder material forms receiving regions which receive molten solder material when the fuse responds. The interfacial energy between the solder material and the receiving regions is lower than the interfacial energy between the solder material and the printed circuit board surface between the two bridged metal surfaces. When the solder material fuses, the receiving regions are, therefore, wetted with liquid solder material, with the result that solder material flows off from the printed circuit board region between the two metal surfaces and the electrical contact formed by the solder material is interrupted.

In the method according to the invention, the receiving regions are formed by covering the corresponding regions of the two metal surfaces with a solder-resistant protective coating prior to applying the solder material. Subsequently, liquid solder material which bridges the gap between the two metal surfaces is applied onto the partial surfaces that are not covered by the protective coating. After the solder material has solidified, the protective coating in the environment of the solder material is removed, with the result that receiving regions are produced that can be wetted with molten solder material.

Metallized surfaces of a printed circuit board, for example, metal surfaces that are made of copper, can be wetted with solder material much more easily than customary synthetic resin surfaces of printed circuit boards. The interfacial energy between the solder material and the synthetic resin, in particular epoxy resin, is therefore higher than the interfacial energy between the solder material and a metal surface, in particular copper. When it fuses, the solder material, therefore, flows off from the printed circuit board region between the two metal surfaces and wets the receiving regions.

In order to improve the wettability of the receiving regions, these regions are covered with flux, preferably at least in part. Suitable fluxing agents are, in particular, fluxing agents that are based on natural or modified resins, for example, rosin, to which activation additives, such as acids, more particularly stearic acid, salicylic acid and/or adipic acid, may be added. Such fluxing agents are, for example, called F-SW 31, F-SW 32, F-SW 33, or F-SW 34. It is also possible to use fluxing agents which contain zinc chloride and/or ammonium chloride if they are provided in an organic preparation, for example, higher alcohols or fats.

In order to cause the contact between the two metal surfaces to be interrupted when the solder fuses, it is actually sufficient to provide a receiving region or reservoir on one side of the bridged gap. Preferably, however, receiving regions are provided on either side of the gap that is bridged by the solder material. That means that the two metal surfaces each form a contact region that is covered with solder material as well as a receiving region.

Preferably, the at least one receiving region surrounds the solder material, for example, in the form of a U or a C. This allows achieving that liquid solder material can wet the receiving regions particularly rapidly. This is to advantage in that the fuse can respond with corresponding rapidness.

Together, the receiving regions are, preferably, at least as large as the printed circuit board region between the two metal surfaces that is covered with solder material. This measure is to advantage in that solder material covering the printed circuit board between the two metal surfaces can migrate into the receiving regions almost completely when the cut-out responds.

According to common linguistic usage, a soft solder material is to be interpreted as a solder material the melting point of which is less than 450° C. Preferred use is made of solder material with a considerably lower melting point, for example, less than 250° C., more particularly less than 200° C. Suitable are, for example, tin alloys, in particular tin-lead alloys and/or indium alloys.

BRIEF DESCRIPTION OF THE DRAWINGS

Further details and advantages of the invention will be illustrated by means of exemplary embodiments of the invention with reference being made to the accompanying drawings. Therein, equal parts that are corresponding to each other are designated with corresponding reference symbols. In the Figures.

DETAILED DESCRIPTION

Before discussing example embodiments of the invention, it will be appreciated that the present invention includes methods as well as apparatuses. Methods of the invention may be useful to make apparatuses of the invention. It will therefore be appreciated that in describing a method of the invention description of an apparatus may be had, and vice versa.

Figure 1:
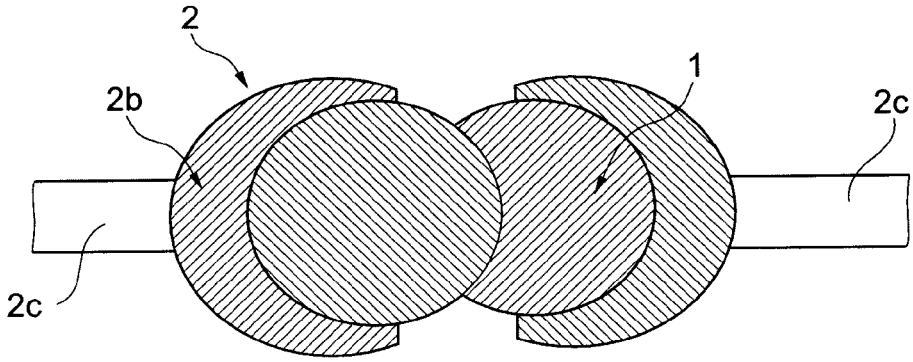
FIG. 1 shows a schematic diagram of a fuse.

FIG. 1 shows a schematic diagram of the structure of an exemplary embodiment of a fuse according to the invention. The fuse is formed by soft solder material 1, for example, L-Sn60PbAg or an indium alloy, which covers a contact region 2*a* of each of two metal surfaces 2 and bridges a gap therebetween. As shown in FIG. 1, the soft solder material 1 covers only a part of each of the two metal surfaces 2. A partial region 2*b* that is arranged adjacent to the contact region 2*a* and is covered by the soft solder material 1 is free from the solder material 1 and forms a receiving region which is wetted with molten solder material 1 if the cut-out responds.

Figure 2:
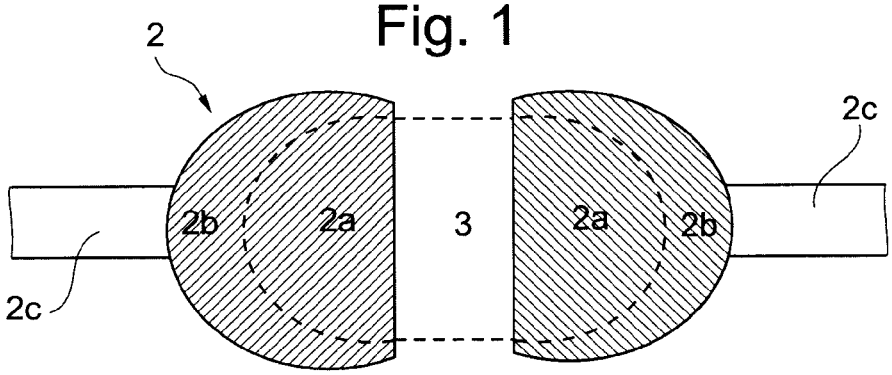
FIG. 2 shows the metal surfaces of FIG. 1, said surfaces being bridged by solder material.

FIG. 2 shows the metal surfaces 2 of the exemplary embodiment shown in FIG. 1 without any solder material 1. Therein, the contact regions 2*a* that are covered with soft solder material 1 and the receiving regions 2*b* that are not covered with soft solder material are plotted in the metal surfaces 2.

When the solder material 1 fuses, the receiving regions 2*b* are wetted by the solder material 1. As a result, the solder material 1 is drawn off from the printed circuit board region 3 between the two metal surfaces 2 and the electrical contact formed by the solder material 1 is interrupted.

Figure 3:
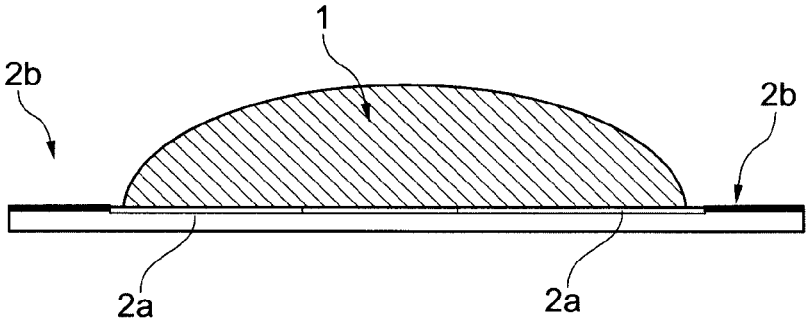
FIG. 3 shows a lateral view of FIG. 1.
Figure 4:
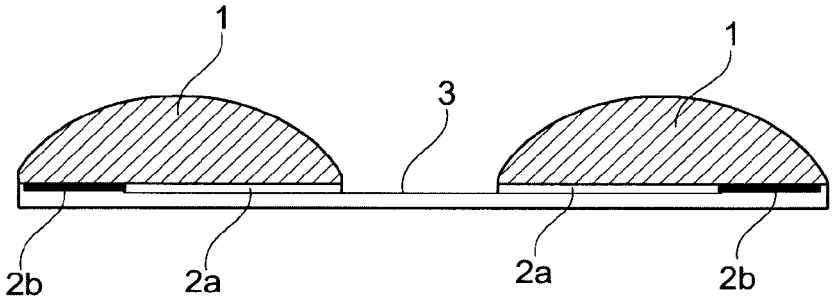
FIG. 4 shows the fuse shown in FIG. 1 in the tripped state.

FIG. 3 shows a lateral view of FIG. 1 in a schematic diagram. FIG. 4 shows a corresponding lateral view after the fuse has tripped. In the tripped state, the solder material 1 wets the receiving regions 2*b* which surround the contact regions 2*a*. The section 3 of the printed circuit board surface that is disposed between the two metal surfaces 2 is largely free from solder material 1 when the fuse is in the tripped state.

To manufacture the fuse shown in FIG. 1, the partial surfaces of the metal surfaces 2 that are provided for the receiving regions 2*b* are, in a first step, covered with a solder-resistant protective coating, for example, masking lacquer. Subsequently, the parts of the metal surfaces 2 that are provided as contact regions 2*a* and are not covered with the solder-resistant protective coating are covered with liquid solder material 1. The solder material 1 applied therein is also used to bridge the gap 3 on the printed circuit board surface that is existing between the contact regions 2*a*, with the result that the two metal surfaces 2 are connected by the solder material 1 in an electrically conducting manner. After the solder material 1 has solidified, the protective coating is removed from the receiving regions 2*b*. In an example, the protective coating is removed through the influence of radiation. In another example, the protective coating is designed as a film and is removed by being pulled off.

In order to improve the wettability of the receiving regions 2*b*, these regions can be covered with flux either partially or completely. The metal surfaces 2 are made of a material that is customary for solder tracks, for example, copper with potential coatings. In the exemplary embodiment shown, the receiving regions 2*b* and the contact regions 2*a* are, together, designed as extended end sections of the pcb-tracks 2*c*. The printed circuit board region 3 that is disposed between the two metal surfaces 2 and is covered with the solder material 1 can, for example, consist of an epoxy resin that is customary for printed circuit boards.

The receiving regions 2*b* surround the contact regions 2*a* in the form of a U or a C. When the cut-out trips, molten solder material 1 can, therefore, flow across an advantageously large circumferential surface and into the receiving regions 2*b*. Together, the receiving regions 2*b* are, preferably, larger than the surface 3 that is disposed between the two metal surfaces 2 and is covered with solder material 1. In this manner, there is sufficient space to receive the solder material 1 bridging the gap 3 between the two metal surfaces 2 when the cut-out trips. In the schematic diagram of FIG. 1, the receiving regions 2*b* appear to be somewhat smaller than the contact regions 2*a* surrounded by said receiving regions 2*b*. Preferably, however, the receiving regions 2*b* are at least as large as the contact regions 2*a* surrounded by said receiving regions 2*b*.

The fuse described above can, for example, be used in the event of a fault to interrupt a load current of a field-effect transistor, more particularly of a MOSFET, arranged on the printed circuit board. To achieve this, the fuse is thermally coupled to the field-effect transistor, for example, by being arranged in the immediate vicinity of the transistor. During operation, a load current to be switched by the field-effect transistor flows through the fuse. In the event of a fault, a heating of the field-effect transistor causes the solder material 1 to fuse, which will then wet the receiving regions 2*b* and, therein, flow off from the space between the two contact regions 2*a*, with the result that the cut-out responds and an electrical contact between the two metal surfaces 2 is interrupted.

In the exemplary embodiment shown in FIGS. 1 to 4, the two metal surfaces 2 each have a straight edge on their sides that are facing each other. However, other shapes are also possible in addition thereto. For example, one of the two contact regions 2*a* can have an indentation on its edge, with the other contact region 2*a* projecting into said indentation with a projection formed on its edge. In particular, the contact regions 2*a* can engage each other in a toothed manner.

Figure 6:
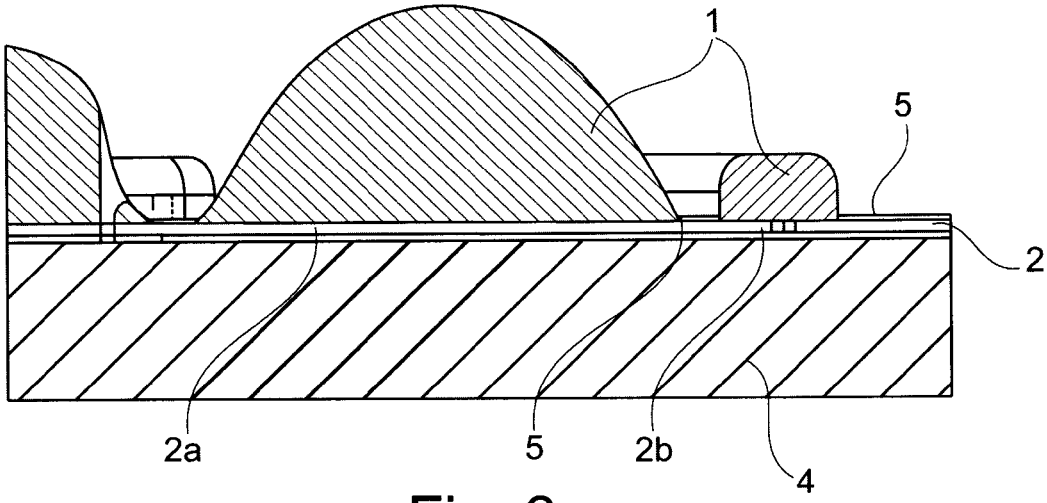
FIG. 6 shows a sectional view of FIG. 5.
Figure 5:
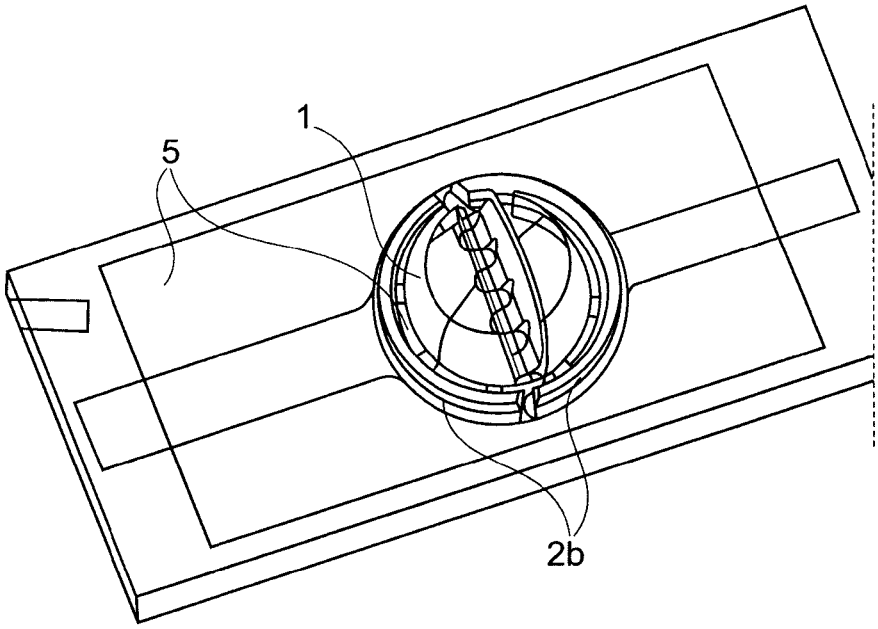
FIG. 5 shows a further exemplary embodiment of a fuse in the tripped state.

FIG. 5 show a schematic diagram of a corresponding exemplary embodiment of a fuse in the tripped state. In this context, FIG. 6 shows a sectional view of a detail of FIG. 5. In the exemplary embodiment shown in FIG. 5, the two contact regions 2*a* that are covered with solder material 1 engage each other in the manner of a meander. The contact regions 2*a* are surrounded by C-shaped receiving regions 2*b* which are also covered with solder material 1 because the cut-out is shown in the tripped state.

A special feature of the exemplary embodiment shown in FIGS. 5 and 6 is that the solder-resistant protective coating 5 has not been completely removed from the metal surfaces 2 but continues to cover partial surfaces between the contact region 2*a* and the receiving region 2*b*. In this exemplary embodiment, the protective coating 5 was only removed in a few transition regions which connect the receiving regions 2*b* with the contact regions 2*a*.

FIG. 6 shows the printed circuit board 4, the metal surfaces 2 arranged thereon, the solder material 1, and the protective coating 5 which, in the exemplary embodiment shown in FIG. 5, has not been completely removed from the metal surfaces 2.

FIG. 6 shows the solder material 1 schematically. In fact, the shape of a solder drop that results when solder material fuses and subsequently solidifies is an approximately symmetrical dome. Some of the edges of the solder material 1 are shown excessively steep in FIG. 6.

REFERENCE SYMBOLS

1 Solder material
2 Metal surfaces
2*a* Contact region
2*b* Receiving region
2*c* Track
3 Printed circuit board surface between the metal surfaces
4 Printed circuit board
5 Protective coating In considering the above description and attached Figures, it will be appreciated that some example embodiments of the invention have been shown and described. Many other embodiments are possible and within the scope of the invention as claimed. Also, substitutes and equivalents to various elements of invention embodiments will be apparent to those knowledgeable in the art involved. Various steps of example methods could be changed in order, different elements from different embodiments interchanged with one another, and the like.

The invention claimed is:

1. A method for forming a fuse which electrically connects two metal surfaces that are arranged on a printed circuit board next to each other and spaced apart from each other, comprising the steps of:

partially covering the two metal surfaces with a protective coating, the protective coating is formed by solder mask, while a partial region forming a contact region remains uncovered, applying liquid soft solder material onto the two uncovered partial regions to bridge the gap between the two metal surfaces and after the soft solder material has solidified, removing the protective coating in a surrounding area of the solder material to form receiving regions which are wetted by the solder material when the latter fuses, with the result that solder material flows off from a printed circuit board region between the two metal surfaces and the electrical contact formed by the solder material is interrupted.

2. The method according to claim 1, wherein the protective coating is removed through the influence of radiation.

3. The method according to claim 1, wherein the protective coating is designed as a film and is removed by being pulled off.

4. The method according to claim 1, wherein flux is applied onto the two metal surfaces.

5. The method according to claim 1, wherein the protective coating is applied such that the protective coating surrounds the contact region.

6. The method according to claim 1, wherein the protective coating is applied such that the protective coating surrounds the contact region in the form of a bend.

7. A method for forming a fuse which electrically connects two metal surfaces that are arranged on a printed circuit board next to each other and spaced apart from each other, comprising the steps of:

partially covering the two metal surfaces with a solder-resistant protective coating, while a partial region forming a contact region remains uncovered, wherein the solder-resistant protective coating surrounds the contact region in a U or C shape, after the partially covering, applying liquid soft solder material onto the two uncovered partial regions to bridge the gap on a surface of the printed circuit board between the two metal surfaces, after the soft solder material has solidified, removing the solder-resistant protective coating in a surrounding area of the solder material to form receiving regions which are wetted by the solder material when the latter fuses, with the result that solder material flows off from a printed circuit board region between the two metal surfaces and the electrical contact formed by the solder material is interrupted.

* * * * *

UNITED STATES PATENT AND TRADEMARK OFFICE

CERTIFICATE OF CORRECTION

PATENT NO. : 8,705,249 B2
APPLICATION NO. : 12/873616
DATED : April 22, 2014
INVENTOR(S) : Luppold et al.

It is certified that error appears in the above-identified patent and that said Letters Patent is hereby corrected as shown below:

Title Page: Item (73) Assignee:

Left Column, line 5,
Assignee, line 1

Please delete "Borgwarner Beru Systems GMbH" and insert
--BorgWarner BERU Systems GmbH-- therefor.

Signed and Sealed this
Ninth Day of December, 2014

Michelle K. Lee

Michelle K. Lee
*Deputy Director of the United States Patent and Trademark Office*